US008702880B2

(12) United States Patent
Cho et al.

(10) Patent No.: US 8,702,880 B2
(45) Date of Patent: Apr. 22, 2014

(54) HIGH STRENGTH AND LOW YIELD RATIO STEEL FOR STRUCTURE HAVING EXCELLENT LOW TEMPERATURE TOUGHNESS

(75) Inventors: Jae Young Cho, Pohang (KR); Kyung Keun Um, Pohang (KR); Jong Kyo Choi, Pohang (KR)

(73) Assignee: Posco (KR)

( * ) Notice: Subject to any disclaimer, the term of this patent is extended or adjusted under 35 U.S.C. 154(b) by 534 days.

(21) Appl. No.: 12/741,401

(22) PCT Filed: Sep. 12, 2008

(86) PCT No.: PCT/KR2008/005435

§ 371 (c)(1), (2), (4) Date: May 5, 2010

(87) PCT Pub. No.: WO2009/066863

PCT Pub. Date: May 28, 2009

(65) Prior Publication Data

US 2010/0263773 A1 Oct. 21, 2010

(30) Foreign Application Priority Data

Nov. 22, 2007 (KR) ..... 10-2007-0119524

(51) Int. Cl.
*C22C 38/00* (2006.01)
*C21D 8/02* (2006.01)

(52) U.S. Cl.
USPC ..... 148/645; 148/330; 420/84

(58) Field of Classification Search
CPC ..... C22C 38/02; C22C 38/04; C22C 38/06; C22C 38/12; C22C 38/14
USPC ..... 148/645, 330; 420/84
See application file for complete search history.

(56) References Cited

U.S. PATENT DOCUMENTS 6,159,312 A 12/2000 Koo et al.

(Continued)

FOREIGN PATENT DOCUMENTS

| | | | |
|---|---|---|---|
| JP | 2005060825 | A | 3/2005 |
| JP | 2007254857 | A | 10/2007 |
| KR | 20020051254 | A | 6/2002 |
| KR | 1020040089746 | A | 10/2004 |

(Continued)

*Primary Examiner* — Jessee Roe
(74) *Attorney, Agent, or Firm* — The Webb Law Firm

(57) ABSTRACT

A high strength and low yield ratio steel that has excellent characteristics such as low temperature toughness, a tensile strength of approximately 600 MPa or more and a low yield ratio of 80% or less. The high strength and low yield ratio steel includes, by weight percent: C: 0.02 to 0.12%, Si: 0.01 to 0.8%, Mn: 0.3 to 2.5%, P: 0.02% or less, S: 0.01% or less, Al: 0.005 to 0.5%, Nb: 0.005 to 0.10%, B: 3 to 50 ppm, Ti: 0.005 to 0.1%, N: 15 to 150 ppm, Ca: 60 ppm or less, and the balance of be and inevitable impurities, and further includes at least one component selected from the group consisting of by weight percent: Cr: 0.05 to 1.0%, Mo: 0.01 to 1.0%, Ni: 0.01 to 2.0%, Cu: 0.01 to 1.0% and V: 0.005 to 0.3%, wherein a finish cooling temperature is limited to 500 to 600° C. after the finish-rolling process. The high strength and low yield ratio steel satisfying characteristics such as low temperature toughness, brittle crack arrestability and low yield ratio, and the manufacturing method thereof may be provided.

5 Claims, 4 Drawing Sheets

(56) References Cited

U.S. PATENT DOCUMENTS

| | | | | |
|---|---|---|---|---|
| 6,224,689 | B1 * | 5/2001 | Koo et al. | 148/320 |
| 6,228,183 | B1 | 5/2001 | Bangaru et al. | |
| 6,254,698 | B1 | 7/2001 | Koo et al. | |
| 6,264,760 | B1 | 7/2001 | Tamehiro et al. | |
| 2006/0065335 | A1 | 3/2006 | Mizutani et al. | |
| 2007/0193666 | A1 * | 8/2007 | Asahi et al. | 148/654 |
| 2009/0136378 | A1 | 5/2009 | Satou et al. | |
| 2009/0301613 | A1 * | 12/2009 | Koo et al. | 148/537 |

FOREIGN PATENT DOCUMENTS

| | | | |
|---|---|---|---|
| KR | 100723171 | B1 | 5/2007 |
| KR | 1020070076529 | A | 7/2007 |
| WO | 9838345 | A1 | 9/1998 |
| WO | 9905335 | A1 | 2/1999 |
| WO | 9905336 | A1 | 2/1999 |
| WO | 0037689 | A1 | 6/2000 |
| WO | 0039352 | A2 | 7/2000 |
| WO | 0040764 | A2 | 7/2000 |

* cited by examiner

【Figure 1】
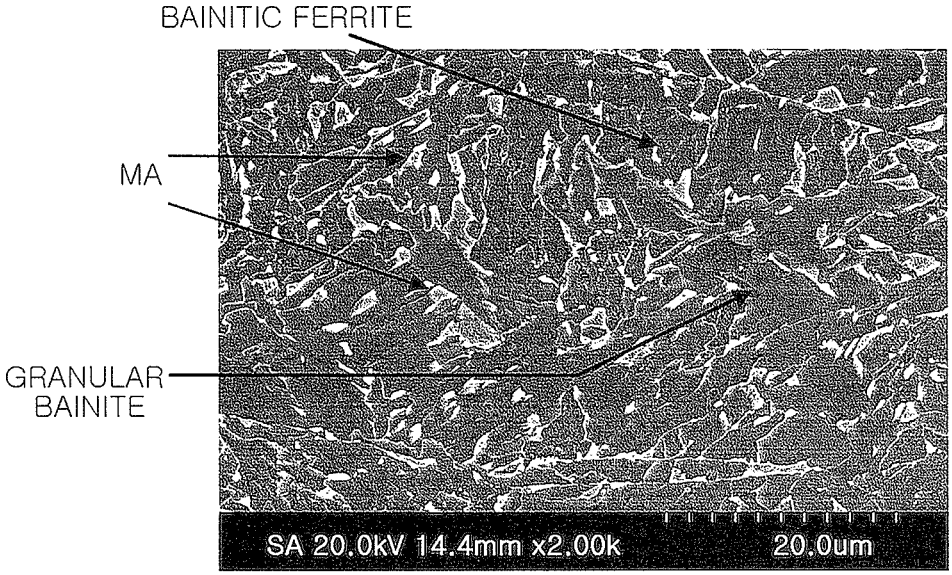

【Figure 2】
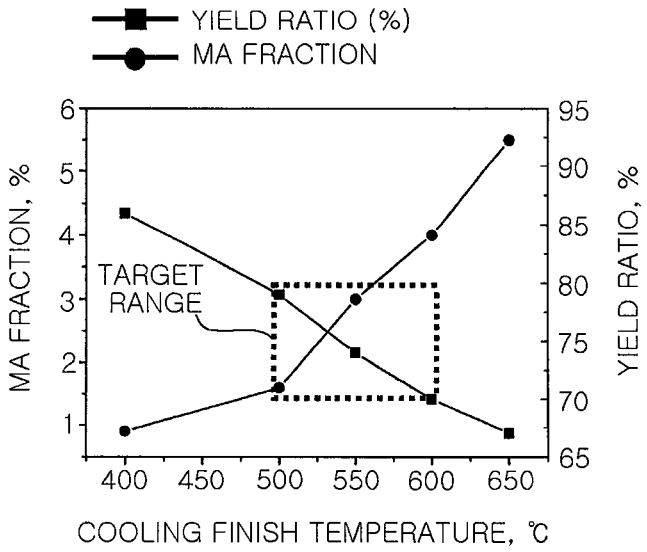

【Figure 3】
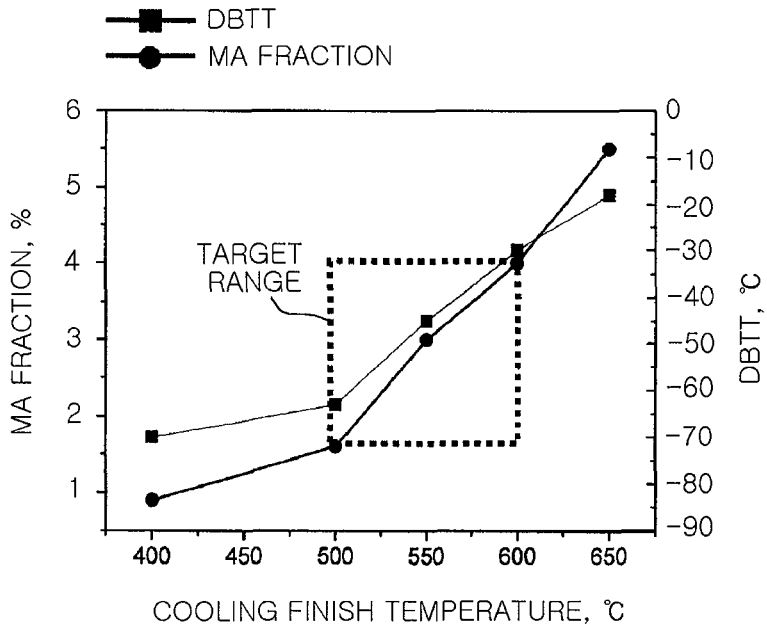

【Figure 4】
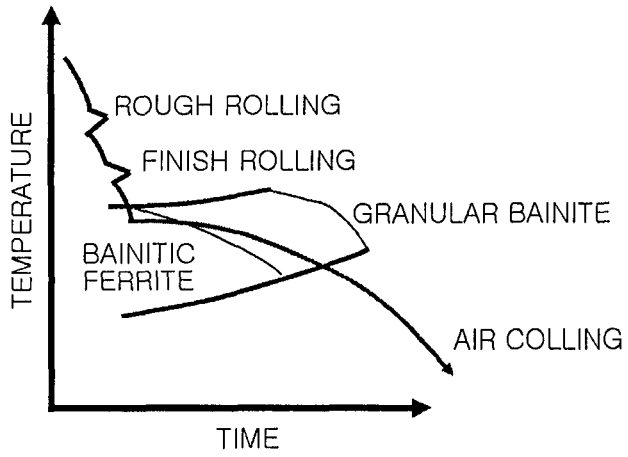

HIGH STRENGTH AND LOW YIELD RATIO STEEL FOR STRUCTURE HAVING EXCELLENT LOW TEMPERATURE TOUGHNESS

BACKGROUND OF THE INVENTION

1. Field of the Invention

The present invention relates to a high strength and low yield ratio steel for structure having excellent characteristics such as low temperature toughness and a manufacturing method thereof, and more particularly, to a high strength steel satisfying excellent main characteristics such as low temperature toughness and low yield ratio, both of which are required for steel for structure, by employing method using a matrix structure of steel as bainitic ferrite and granular bainite structures and using dual phase having high hardness, and a manufacturing method thereof.

2. Description of Related Art

Structures such as buildings and bridges mainly require high strength due to their high loads. Also, the total weight of used steel tends to be reduced with continued demand for reduction in the cost of construction materials used to build constructional structures. Therefore, there has been an increasing demand for an increase in strength of steel constituting these constructional structures.

However, since the steel has a problem in that its properties such as low temperature toughness may be often deteriorated with its increasing strength, a lot of high strength steels for structure has poor low temperature toughness. The low temperature toughness is the measure on how long steel ensures brittle fracture at ultra-low temperature, and steels having poor low temperature toughness have a problem in that brittle fracture may occur easily in the steels when the steels are used in severe low-temperature regions such as extreme regions, which leads to the limitations on use environments of the steels. A ductile-brittle transition temperature (DBTT curve) is generally used as the measure of low temperature toughness.

Also, the increase in strength of steel results often in the increase in a yield ratio that is a ratio of yield strength to tensile strength. Then, the increase in the yield ratio reduces the stress difference from a time point (yield point) that plastic deformation of steel occurs to a time point that fracture of steel occurs. Therefore, since buildings have little preparation time to prevent destruction of the buildings by absorbing energy through their deformations, it is difficult to secure the safety of constructional structures when the constructional structures are exposed to tremendous external forces such as earthquakes.

Therefore, the steels for structure should necessarily have low temperature toughness and low yield ratio, both of which are maintained over certain levels.

As one of alternative technologies to secure a low yield ratio of steel, there is a method for enhancing low yield ratio of steel by selecting suitable alloying elements of the steel and suitably adjusting rolling conditions. This technology is to improve tensile strength of steel, and thus to secure a low yield ratio of steel by adjusting alloying elements to suitable ranges, finish cooling temperature below 500° C. to form a bainitic ferrite structure, heat-treating the bainitic ferrite structure at an intercritical temperature range of 700 to 760° C. to form austenite between bainite laths, and slowly cooling the austenite to obtain a MA (Martensite or/and residual austenite) structure.

In order to make a microstructure of steel as a bainitic ferrite structure, the finish cooling temperature should, however, be adjusted to a temperature below $B_f$ temperature that is a bainite transformation finish temperature. In this case, problems associated with low productivity may occur in production line. Also, the process of obtaining a MA structure by the heat-treatment of the bainitic ferrite structure at the intercritical temperature range after the rolling process has problems associated with the delayed supplies of the products, the increased manufacturing cost, the reduced productivity, etc.

Therefore, there is a demand for development of steel having high productivity as well as satisfying requirements such as high strength characteristics, low temperature toughness characteristics and low yield ratio.

The present invention is designed to solve the problems of the prior art, and therefore it is an object of the present invention to provide a high strength steel satisfying all characteristics such as low temperature toughness and low yield ratio.

Also, it is another object of the present invention to provide a method for manufacturing a high strength steel satisfying all characteristics such as low temperature toughness and low yield ratio.

SUMMARY OF THE INVENTION

According to an aspect of the present invention, there is provided a high strength and low yield ratio steel for structure including, by weight percent: C: 0.02 to 0.12%, Si: 0.01 to 0.6%, Mn: 0.3 to 2.5%, Nb: 0.005 to 0.10%, Ti: 0.005 to 0.1%, Al: 0.005 to 0.5%, P: 0.02% or less, B: 5 to 40 ppm, N: 15 to 150 ppm, Ca: 60 ppm or less, S: 100 ppm or less, and the balance of Fe and inevitable impurities, wherein high strength and low yield ratio steel is composed of 1 to 5% by weight percent of a MA (martensite/austenite) structure having an average particle size of 5 μm or less, and the balance of a duplex structure of granular bainite and bainitic ferrite.

In this case, the high strength and low yield ratio steel for structure may further include at least component selected from the group consisting of, by weight percent: Cr: 0.05 to 1.0%, Mo: 0.01 to 1.0%, Ni: 0.01 to 2.0%, Cu: 0.01 to 1.0% and V: 0.005 to 0.3%.

According to another aspect of the present invention, there is provided a method for manufacturing a high strength and low yield ratio steel. Here, the method includes: re-heating a steel slab at 1050 to 1250° C., the steel slab including, by weight percent: C: 0.02 to 0.12%, Si: 0.01 to 0.8%, Mn: 0.3 to 2.5%, P: 0.02% or less, S: 0.01% or less, Al: 0.005 to 0.5%, Nb: 0.005 to 0.10%, B: 3 to 50 ppm, Ti: 0.005 to 0.1%, N: 15 to 150 ppm, Ca: 60 ppm or less, and the balance of Fe and inevitable impurities; rough-rolling the re-heated steel slab at a temperature range of 1250° C. to $T_{nr}$ (recrystallization stop temperature); and cooling the rough-rolled steel slab to a finish cooling temperature of 500 to 600° C. at a cooling rate of 2 to 10° C./s.

As described above, the exemplary embodiments of the present invention may provide a steel having a high strength of 600 MPa or more and satisfying characteristics such as low temperature toughness, brittle crack arrestability and low yield ratio of 80% or less.

Also, the exemplary embodiments of the present invention may provide a high strength steel satisfying all characteristics such as low temperature toughness, brittle crack arrestability and low yield ratio of 80% or less.

BRIEF DESCRIPTION OF DRAWINGS

FIG. 1 is a photograph illustrating a microstructure of steel according to one exemplary embodiment of the present invention that is observed with a scanning electron microscope.

FIG. 2 is a graph illustrating the relation between a fraction of MA structure and a yield ratio according to one exemplary embodiment of the present invention, depending on the finish cooling temperature.

FIG. 3 is a graph illustrating the relation between a fraction of MA structure and a ductile-brittle transition temperature (DBTT) according to one exemplary embodiment of the present invention, depending on the cooling finish temperature.

FIG. 4 is a graph schematically illustrating temperature behaviors in inner parts of slabs with the time during a manufacturing process according to one exemplary embodiment of the present invention.

DETAILED DESCRIPTION OF THE INVENTION

Hereinafter, one exemplary embodiment of the present invention provides a steel for structure having a tensile strength of 600 MPa or more and a yield ratio of 80% or less by controlling alloying element systems, the fraction and average size of MA structure and adjusting rolling conditions.

Hereinafter, the alloying systems and their limit ranges according to one exemplary embodiment of the present invention are described in detail.

C: 0.02 to 0.12%

Carbon (C) is an essential important element that is used to form a martensite-austenite constituent (MA) and determines the size and fraction of the martensite-austenite constituent. Therefore, the Carbon (C) is included in a suitable content range in accordance with the present invention. However, when the content of C exceeds 0.12%, low temperature toughness of steel may be deteriorated, and a fraction of the martensite-austenite constituent may exceed 15%. On the contrary, when the content of C is less than 0.02%, strength of steel is low due to the low fraction (3% or less) of the martensite-austenite constituent. Therefore, C is used in a limited content of 0.02 to 0.12%. In addition, in the case of a steel plate used in a welding steel structure, C is preferably used at a content range of 0.03 to 0.09% so as to secure better weldability.

Si: 0.01 to 0.8%

Silicone (Si) is used as a deoxidizing element to enhance stability of the martensite-austenite constituent. Therefore, Si aids to improve strength and toughness of steel since a large amount of a martensite-austenite constituent may be formed even at the small C content. Here, when the content of Si exceeds 0.8%, low temperature toughness and weldability of steel may be deteriorated. On the contrary, a deoxidizing effect of Si is insufficient when the content of Si is less than 0.01%. Therefore, Si may be used in a limited content range of 0.01 to 0.8%, and preferably 0.1 to 0.4%.

Mn: 0.3 to 2.5%

Manganese (Mn) is a useful element to improve strength of steel by solid solution hardening. In this case, Mn is necessarily added at a content of 0.3% or more. However, when the content of Mn exceeds 2.5%, toughness of a welding portion may be deteriorated due to the excessive increase in hardenability. Therefore, Mn is used in a limited content range of 0.3 to 2.5%.

P: 0.02% or Less

Phosphorus (P) is an element that is effective to enhance strength and improve corrosion resistance. However, P is desirably used at as low content as possible since it may highly degrade impact toughness. Also, its upper limit is defined to be 0.02%.

S: 0.01% or Less

Sulfur (S) is an element that reacts to form sulfides such as MnS, which highly degrade impact toughness. Therefore, S is desirably used at as low content as possible, and its upper limit is defined to be 0.01%.

Al: 0.005 to 0.5%

Aluminum (Al) is a cheap element that may deoxidize a molten steel. Here, since sol.Al facilitates formation of the martensite-austenite constituent, a small amount of Al may be used to form a martensite-austenite constituent, which aids to improve strength and toughness of steel. Therefore, added Al may be included in a content of 0.005% or more. However, when the content of added Al exceeds 0.5%, a nozzle may be clogged during a continuous casting process. Therefore, Al is used in a limited content range of 0.005 to 0.5%. Preferably, Al may be used at a content range of 0.01 to 0.05%.

Nb: 0.005 to 0.1%

Niobium (Nb) is an important element that is used to manufacture a TMCP steel, and precipitated in the form of NbC or NbCN to highly improve strength of the parent metal and its welding portion. Also, solutionized Nb during re-heating has an effect on refining a structure by suppressing recrystallization of austenite and transformation of ferrite or bainite. In addition, in accordance with one exemplary embodiment of the present invention, Nb helps to form bainite at a slow cooling rate when a slab is cooled after a rough-rolling process, and also to enhance stability of austenite when the slab is cooled after the final rolling process, thereby facilitating formation of a martensite-austenite constituent even at the slow cooling rate. Therefore, Nb should be added at a content of 0.005% or more. However, when Nb is added at an excessive amount of greater than 0.1%, brittle cracks may occur in edges of steel. Therefore, Nb is used in a limited content range of 0.005 to 0.1%.

B: 3 to 50 ppm

Boron (B) is a useful element that is very cheap and shows its potent hardenability. In particular, in accordance with one exemplary embodiment of the present invention, B highly contributes to forming bainite even at a slow cooling rate during a cooling process after the rough-rolling process, and has an effect to aid to form a martensite-austenite constituent even at a final cooling process. Since a small amount of added B results in the highly increased strength, B is desirably added at a content of 3 ppm or more. However, the addition of excessive B may rather degrade hardenability of steel by formation of $Fe_{23}(CB)_6$, and deteriorate characteristics such as low temperature toughness. Therefore, the added B is used in a limited content range of 3 to 50 ppm.

Ti: 0.005 to 0.1%

Titanium (Ti) functions to highly improve low temperature toughness of steel by suppressing growth of crystal grains when the steel is re-heated. In this case, Ti is desirably added at a content of 0.005% or more. However, When Ti is added at an excessive amount of 0.1% or more, a cast nozzle may be clogged, or low temperature toughness of steel may be degraded by crystallization in central region of the steel. Therefore, Ti is used in a limited content range of 0.005 to 0.1%.

N: 15 to 150 ppm

Nitrogen (N) is to increase strength of steel, but reduces toughness of the steel. Therefore, it is necessary to define a content of N to a content level of 150 ppm or less. However, the control of 15 ppm or less of N causes a difficulty in steel making, and therefore a lower limit of the N content is set to 15 ppm.

The above-mentioned steel having advantageous steel components and their contents according to one exemplary embodiment of the present invention may have sufficient effects only when the steel includes the above-mentioned content ranges of the alloying elements. However, in order to improve characteristics such as strength and toughness of steel, toughness of a welding heat-affected zone, weldability and the like, the following alloying elements may be further added at suitable contents. The following alloying elements may be used alone, or in combinations thereof.

Cr: 0.05 to 1.0%

Chromium (Cr) has a huge effect to enhance hardenability of steel, thereby enhancing strength of the steel. In this case, Cr is desirably added at a content of 0.05% or more. When the content of added Cr exceeds 1.0%, weldability may be deteriorated. Therefore, Cr is used in a limited content of 1.0% or less. Also, Cr is more preferably added at a content range of 0.2 to 0.5% to stably obtain a martensite-austenite (MA) constituent at a relatively slow cooling rate.

Mo: 0.01 to 1.0%

Molybdenum (Mo) has an effect on the suppression of ferrite formation since a small amount of Mo highly enhances hardenability of steel. In particular, in accordance with one exemplary embodiment of the present invention, Mo is added at a content of 0.01% or more since it aids to form a martensite-austenite constituent that is helpful to increase tensile strength. However, when the content of Mo exceeds 1.0%, hardness of a welding portion may be excessively increased, and its toughness may be deteriorated. Therefore, Mo may be desirably added at a content of 1.0% or less. In order to enhance hardenability of the steel, Mo is more preferably used in a limited content range of 0.02 to 0.2%.

Ni: 0.01 to 2.0%

Nickel (Ni) is an element that may improve both strength and toughness of steel. In order to achieve the sufficient effect, Ni should be added at a content of 0.01% or more. However, Ni is expensive, and therefore the economical efficiency may be low and weldability may be degraded when the content of added Ni exceeds 2.0%. Therefore, Ni is added in a limited content range of 0.01 to 2.0%.

Cu: 0.01 to 1.0%

Copper (Cu) is an element that may minimize degradation of toughness of steel, and simultaneously enhance strength of steel. In order to achieve the sufficient effect, Cu should be added at a content of 0.01% or more. However, an upper limit of Cu is defined to be 1.0% since the addition of excessive Cu may rather highly degrade surface qualities of the products.

V: 0.005 to 0.3%

Vanadium (V) has a lower solid-solution temperature than those of other microalloys and has an effect to prevent degradation of the strength of steel since V is precipitated around a welding heat-affected zone. Therefore, V is added at a content of 0.005% or more. However, when the content of V exceeds 0.3%, toughness of steel may be rather degraded. As a result, V is added in a limited content range of 0.005 to 0.3%.

Ca: 0 to 0.006% by Weight

Calcium (Ca) is widely used as an element that controls shapes of a MnS inclusion and improves low-temperature toughness of steel. However, the addition of excessive Ca causes formation of a coarse inclusion by a large amount of CaO—CaS, which may lower cleanliness level of steel, and also degrade weldability. Therefore, Ca is added at a content of no more than 0.006% by weight.

The steel having the above-mentioned composition according to one exemplary embodiment of the present invention has more improved hardenability than conventional steels, and shows its characteristics of forming a desired structure in an inner part of the steel without undergoing a sudden water-cooling process.

Hereinafter, a microstructure of steel according to one exemplary embodiment of the present invention is described in more detail.

When the hardenability of steel is improved and a hard structure is formed in steel, the low-temperature toughness of the steel was often deteriorated. In connection with this fact, desirable structures of the steel according to one exemplary embodiment of the present invention are stipulated, as follows. Therefore, the steel according to one exemplary embodiment of the present invention may be formed to prevent its low temperature toughness from being deteriorated and easily realize a low yield ratio even when the hardenability of the steel is improved.

The microstructure of the steel according to one exemplary embodiment of the present invention includes 1 to 5% of a MA structure (martensite/austenite duplex structure) having an average size of 5 μm (micrometers), and the balance of a duplex structure of granular bainite and bainitic ferrite, as shown in FIG. 1.

The present invention is not particularly limited to the fraction between granular bainite and bainitic ferrite in the case of the duplex structure. This is why both of the granular bainite and bainitic ferrite are matrix structures whose physical properties, such as yield strength and yield ratio, are not particularly changed according to the fractions of both the granular bainite and bainitic ferrite structures.

In accordance with one exemplary embodiment of the present invention, a structure that is able to improve characteristics such as low yield ratio and low temperature toughness is realized by defining a finish cooling temperature to a suitable temperature range. Referring to FIG. 2, the increase in the finish cooling temperature leads to an increase in the MA fraction but a decrease in the yield ratio. It seems that this is why a fraction of the granular bainite as a relatively soft matrix structure increases, as the finish cooling temperature increases, which leads to a decrease in the yield strength, and the increase in the MA fraction results in the increase of the tensile strength.

Also, the ductile-brittle transition temperature (DBTT) of the steel is increased when the finish cooling temperature is set to a high temperature as shown in FIG. 3. This is why, since the fraction and average particle size of the MA structure are increased as the finish cooling temperature increases, the steel is easily cracked by external impacts, which leads to the deteriorated toughness of the steel.

Therefore, the results of FIGS. 2 and 3 show that a suitable balance between the MA structure and the granular bainite-bainitic ferrite duplex structure is achieved when the finish cooling temperature is maintained to a temperature level of 500 to 600° C., thus to improve both of the low yield ratio and low temperature toughness.

Hereinafter, the method for manufacturing steel according to one exemplary embodiment of the present invention is described in more detail.

The method for manufacturing steel according to one exemplary embodiment of the present invention includes: re-heating a slab, rough-rolling the re-heated slab, cooling the rough-rolled plate after the rough-rolling process, finish-rolling and cooling the finish-rolled plate. Each step of the manufacturing method is described in more detail, as follows.

Slab Re-Heating Temperature: 1050 to 1250° C.

In accordance with one exemplary embodiment of the present invention, a slab is re-heated at a heating temperature of 1050° C. or above. This is to solutionize precipitated carbonitride of Ti and/or Nb to a sufficient extent during a casting process. However, when the slab is re-heated at an excessively high temperature, the austenite may become coarse. Therefore, an upper re-heating temperature limit of the slab is defined to be 1250° C.

Rough-Rolling Temperature: 1250° C. to $T_{nr}$

The re-heated slab is rough-rolled after the heating process in order to adjust shapes of a slab to a suitable extent. The rough-rolling process is carried out at greater than temperature ($T_{nr}$) at which austenite is not recrystallized any more. During the rolling process, it is possible to break cast structures, such as dendrite, formed during the casting process, and make austenite grain size small.

Finish-Rolling Temperature: $T_{nr}$ to $B_s$

The austenite structure in the rough-rolled slab is finish-rolled in order to induce an inhomogeneous deformed microstructure into the plate. The rolling temperature is in a range from an austenite non-recrystallization temperature ($T_{nr}$) to a greater than bainite transformation start temperature ($B_s$). When the finish rolling process is started at a high temperature greater than $T_{nr}$, the yield strength of the plate is increased, which makes it difficult to obtain a low yield ratio of 80% or less.

Cooling condition after finish-rolling process: Finish cooling temperature at 500 to 600° C. at a cooling rate of 2 to 10° C./s.

The cooling condition is one of major characteristics of the present invention. A microstructure of the steel is formed by water-cooling a plate from a temperature greater than $B_s$ (bainite transformation start temperature) at a cooling rate of 2 to 10° C./s and stopping the cooling of the plate at a temperature range of 500 to 600° C. that is greater than $B_f$(bainite transformation finish temperature), as shown in FIG. 3. Here, the microstructure of the steel includes a 1~5% fraction of an MA structure, wherein the MA structure has an average particle size of 5 μm or less. Productivity of the steel is low when the cooling rate is less than 2° C./s, whereas a cooling curve is not passed through a region of granular bainite as shown in FIG. 4, and a hard bainite structure is formed, when the cooling rate exceeds 10° C./s, which leads to the increases in yield strength and yield ratio.

In conclusion, in the method for manufacturing a steel according to one exemplary embodiment of the present invention, an MA structure is formed by heating a steel slab having the above-mentioned composition to a temperature of 1050 to 1250° C., rough-rolling the heated slab at a temperature of 1250° C. to $T_{nr}$, finish-rolling the rough-rolled plate at a temperature of $T_{nr}$ to $B_s$, and stopping the cooling of the finish-rolled steel slab at a temperature of 500 to 600° C. at a cooling rate of 2 to 10° C./s. Here, the MA structure accounts for 1 to 5% fractions in a duplex structure of granular bainite and bainitic ferrite, and has an average size of 5 μm or less.

[Mode for Invention]

Hereinafter, exemplary embodiments of the present invention will now be described in detail with reference to the accompanying drawings. However, it should be understood that the description proposed herein is just a preferable example for the purpose of illustrations only, not intended to limit the scope of the invention. This is why the scope of the invention is determined by the appended claims and their equivalents.

EXAMPLES

TABLE 1

| | % by weight or ppm | | | | | | | | | | | | | | | | | | |
|---|---|---|---|---|---|---|---|---|---|---|---|---|---|---|---|---|---|---|---|
| Steel No. | C | Si | Mn | P | S | Al | Ni | Cu | Cr | Mo | Ti | Nb | V | B' | N' | Ca' | Bs | Bf | Tnr |
| Inventive steel A | 0.04 | 0.2 | 1.7 | 0.013 | 0.002 | 0.015 | 0 | 0 | 0 | 0 | 0.01 | 0.03 | 0.00 | 6 | 35 | 11 | 624.2 | 504.2 | 930.3 |
| Inventive steel B | 0.08 | 0.4 | 1.5 | 0.013 | 0.005 | 0.032 | 0 | 0 | 0 | 0 | 0.014 | 0.02 | 0.00 | 15 | 55 | 13 | 568.4 | 448.4 | 843.2 |
| Inventive steel C | 0.087 | 0.2 | 1.45 | 0.012 | 0.002 | 0.013 | 0 | 0 | 0 | 0 | 0.02 | 0.05 | 0.00 | 40 | 42 | 14 | 571.0 | 451.0 | 1056.7 |
| Inventive steel D | 0.1 | 0.3 | 1.4 | 0.013 | 0.002 | 0.013 | 0.21 | 0 | 0 | 0 | 0.02 | 0.04 | 0.00 | 8 | 42 | 11 | 564.2 | 444.2 | 977.8 |
| Inventive steel E | 0.072 | 0.2 | 1.5 | 0.013 | 0.002 | 0.013 | 0 | 0.22 | 0 | 0 | 0.02 | 0.03 | 0.00 | 15 | 42 | 13 | 570.6 | 450.6 | 953.3 |
| Inventive steel F | 0.086 | 0.3 | 1.4 | 0.013 | 0.003 | 0.013 | 0 | 0 | 0.24 | 0 | 0.02 | 0.06 | 0.00 | 20 | 42 | 15 | 559.0 | 439.0 | 1071.3 |
| Inventive steel G | 0.09 | 0.4 | 1.6 | 0.013 | 0.002 | 0.013 | 0 | 0 | 0 | 0.11 | 0.02 | 0.04 | 0.00 | 16 | 42 | 17 | 547.6 | 427.6 | 937.5 |
| Inventive steel H | 0.071 | 0.3 | 1.4 | 0.013 | 0.002 | 0.013 | 0 | 0 | 0 | 0 | 0.02 | 0.01 | 0.02 | 14 | 42 | 20 | 579.8 | 459.8 | 817.5 |
| Comp. steel A | 0.01 | 0.2 | 1.5 | 0.014 | 0.003 | 0.034 | 0 | 0 | 0 | 0 | 0.012 | 0.03 | 0.00 | 20 | 32 | 11 | 587.3 | 467.3 | 925.1 |
| Comp. steel B | 0.17 | 0.3 | 0.8 | 0.013 | 0.001 | 0.038 | 0 | 0 | 0 | 0 | 0.013 | 0.04 | 0.00 | 24 | 28 | 14 | 607.1 | 487.1 | 1013.1 |
| Comp. steel C | 0.09 | 0.4 | 1.2 | 0.013 | 0.005 | 0.024 | 0 | 0 | 0 | 0 | 0.01 | 0.00 | 0.00 | 14 | 26 | 10 | 697.7 | 577.7 | 803.6 |
| Comp. steel D | 0.079 | 0.2 | 1.4 | 0.015 | 0.009 | 0.043 | 0 | 0 | 0 | 0 | 0.009 | 0.04 | 0.00 | 1 | 43 | 8 | 577.7 | 457.7 | 1004.9 |

Each of the slabs prepared with the components and their contents listed in Table 1 were rolled and cooled in the same conditions as listed in Table 2. For these examples, the slabs were tested under a condition of exceeding the cooling rate, and conditions that a finish rolling start temperature exceeds Tnr and a finish cooling temperature is low.

TABLE 2

| | | Rough rolling | | | Finish rolling | | Cooling | | |
|---|---|---|---|---|---|---|---|---|---|
| Kinds | No. | Slab thickness | Reheating extraction Temp. | Rough rolling finish Temp. | Rolling start Temp. | Rolling finish Temp. | Cooling Temp. | Cooling finish Temp. | Note |
| Inventive steel A | A-1 | 244 | 1065 | 985 | 880 | 840 | 6.0 | 580 | Recommended Temp. |
| | A-2 | 244 | 1110 | 1030 | 820 | 780 | 15.0 | 520 | Cooling rate exceeded |

TABLE 2-continued

| Kinds | No. | Rough rolling: Slab thickness | Rough rolling: Reheating extraction Temp. | Rough rolling: Rough rolling finish Temp. | Finish rolling: Rolling start Temp. | Finish rolling: Rolling finish Temp. | Cooling: Cooling Temp. | Cooling: Cooling finish Temp. | Note |
|---|---|---|---|---|---|---|---|---|---|
| | A-3 | 220 | 1050 | 970 | 1010 | 970 | 4.0 | 550 | Finish rolling start Temp. > Thr |
| | A-4 | 220 | 1050 | 970 | 850 | 810 | 5.0 | 350 | Low colling finish Temp. |
| Inventive steel B | B-1 | 244 | 1070 | 990 | 793 | 753 | 6.0 | 555 | Recommended Temp. |
| | B-2 | 244 | 1105 | 1025 | 820 | 780 | 15.0 | 520 | Cooling rate exceeded |
| | B-3 | 220 | 1060 | 980 | 923 | 883 | 4.0 | 502 | Finish rolling start Temp. > Thr |
| | B-4 | 220 | 1060 | 980 | 850 | 810 | 5.0 | 340 | Low colling finish Temp. |
| Inventive steel C | C-1 | 244 | 1080 | 1000 | 1007 | 967 | 6.0 | 570 | Recommended Temp. |
| | C-2 | 244 | 1100 | 1020 | 820 | 780 | 15.0 | 400 | Cooling rate exceeded |
| | C-3 | 220 | 1055 | 975 | 1137 | 1097 | 4.0 | 550 | Finish rolling start Temp. > Thr |
| | C-4 | 220 | 1055 | 975 | 850 | 810 | 5.0 | 350 | Low colling finish Temp. |
| Inventive steel D | D-1 | 244 | 1080 | 1000 | 928 | 888 | 6.0 | 583 | Recommended Temp. |
| | D-2 | 244 | 1100 | 1020 | 820 | 780 | 15.0 | 400 | Cooling rate exceeded |
| | D-3 | 220 | 1155 | 1105 | 1038 | 998 | 4.0 | 502 | Finish rolling start Temp. > Thr |
| | D-4 | 220 | 1055 | 975 | 850 | 810 | 5.0 | 350 | Low colling finish Temp. |
| Inventive steel E | E-1 | 244 | 1080 | 1000 | 903 | 863 | 6.0 | 555 | Recommended Temp. |
| | E-2 | 244 | 1100 | 1020 | 820 | 780 | 15.0 | 500 | Cooling rate exceeded |
| | E-3 | 220 | 1055 | 1035 | 1013 | 973 | 4.0 | 510 | Finish rolling start Temp. > Thr |
| | E-4 | 220 | 1055 | 975 | 850 | 810 | 5.0 | 350 | Low colling finish Temp. |
| Inventive steel F | F-1 | 244 | 1080 | 1000 | 1021 | 981 | 6.0 | 550 | Recommended Temp. |
| | F-2 | 244 | 1100 | 1020 | 820 | 780 | 15.0 | 400 | Cooling rate exceeded |
| | F-3 | 220 | 1055 | 1035 | 1101 | 1061 | 4.0 | 500 | Finish rolling start Temp. > Thr |
| | F-4 | 220 | 1055 | 975 | 850 | 810 | 5.0 | 350 | Low colling finish Temp. |
| Inventive steel G | G-1 | 244 | 1080 | 1000 | 887 | 847 | 6.0 | 545 | Recommended Temp. |
| | G-2 | 244 | 1100 | 1020 | 820 | 780 | 15.0 | 400 | Cooling rate exceeded |
| | G-3 | 220 | 1115 | 1055 | 1017 | 977 | 4.0 | 514 | Finish rolling start Temp. > Thr |
| | G-4 | 220 | 1055 | 975 | 850 | 810 | 5.0 | 350 | Low colling finish Temp. |
| Inventive steel H | H-1 | 244 | 1080 | 1000 | 768 | 728 | 6.0 | 575 | Recommended Temp. |
| | H-2 | 244 | 1100 | 1020 | 820 | 780 | 15.0 | 400 | Cooling rate exceeded |
| | H-3 | 220 | 1055 | 975 | 918 | 878 | 4.0 | 502 | Finish rolling start Temp. > Thr |
| | H-4 | 220 | 1055 | 975 | 850 | 810 | 5.0 | 350 | Low colling finish Temp. |
| Comp. steel I | | 244 | 1080 | 1000 | 875 | 835 | 6.0 | 578 | Recommended Temp. |
| Comp. steel J | | 244 | 1080 | 1000 | 963 | 923 | 6.0 | 582 | Recommended Temp. |
| Comp. steel K | | 244 | 1080 | 1000 | 754 | 714 | 6.0 | 593 | Recommended Temp. |
| Comp. steel L | | 244 | 1080 | 1000 | 1027 | 987 | 6.0 | 567 | Recommended Temp. |

Each of the slabs was prepared according to the conditions listed in Table 2, and the test results of the slabs are listed in the following Table 3.

TABLE 3

| Kinds | No. | Thickness | YS | TS | YR | MA fraction | DBTT |
|---|---|---|---|---|---|---|---|
| Inventive steel A | A-1 | 70 | 501 | 645 | 78 | 3.5 | −39 |
| | A-2 | 65 | 553 | 666 | 83 | 2.2 | −54 |
| | A-3 | 35 | 519 | 638 | 81 | 2.8 | −47 |
| | A-4 | 60 | 550 | 624 | 88 | 0.8 | −73 |
| Inventive steel B | B-1 | 70 | 489 | 645 | 76 | 2.9 | −46 |
| | B-2 | 65 | 548 | 669 | 82 | 2.2 | −54 |
| | B-3 | 35 | 512 | 636 | 81 | 1.9 | −58 |
| | B-4 | 60 | 547 | 626 | 87 | 0.8 | −73 |
| Inventive steel C | C-1 | 65 | 527 | 665 | 79 | 3.2 | −42 |
| | C-2 | 65 | 588 | 677 | 87 | 0.9 | −71 |
| | C-3 | 31 | 542 | 659 | 82 | 2.8 | −47 |
| | C-4 | 60 | 554 | 644 | 86 | 0.8 | −73 |
| Inventive steel D | D-1 | 65 | 507 | 671 | 76 | 3.6 | −38 |
| | D-2 | 65 | 583 | 683 | 85 | 0.9 | −71 |
| | D-3 | 31 | 534 | 660 | 81 | 1.9 | −58 |
| | D-4 | 60 | 549 | 650 | 84 | 0.8 | −73 |
| Inventive steel E | E-1 | 65 | 506 | 692 | 73 | 2.9 | −46 |
| | E-2 | 65 | 590 | 714 | 83 | 1.8 | −58 |
| | E-3 | 31 | 575 | 684 | 84 | 2 | −57 |
| | E-4 | 60 | 544 | 673 | 81 | 0.8 | −73 |
| Inventive steel F | F-1 | 65 | 541 | 695 | 78 | 2.8 | −47 |
| | F-2 | 65 | 594 | 709 | 84 | 0.9 | −71 |
| | F-3 | 31 | 556 | 687 | 81 | 1.8 | −58 |
| | F-4 | 60 | 560 | 676 | 83 | 0.8 | −73 |

TABLE 3-continued

| Kinds | No. | Thickness | YS | TS | YR | MA fraction | DBTT |
|---|---|---|---|---|---|---|---|
| Inventive steel G | G-1 | 65 | 569 | 734 | 78 | 2.7 | −49 |
| | G-2 | 65 | 641 | 749 | 86 | 0.9 | −71 |
| | G-3 | 31 | 587 | 727 | 81 | 2.1 | −56 |
| | G-4 | 60 | 607 | 716 | 85 | 0.8 | −73 |
| Inventive steel H | H-1 | 65 | 457 | 616 | 74 | 3.4 | −41 |
| | H-2 | 65 | 556 | 630 | 88 | 0.9 | −71 |
| | H-3 | 31 | 489 | 606 | 81 | 1.9 | −58 |
| | H-4 | 60 | 522 | 597 | 87 | 0.8 | −73 |
| Comp. steel I | | 65 | 445 | 522 | 85 | 3.4 | −40 |
| Comp. steel J | | 65 | 431 | 510 | 85 | 3.5 | −39 |
| Comp. steel K | | 65 | 414 | 525 | 79 | 3.8 | −35 |
| Comp. steel L | | 53 | 491 | 584 | 84 | 3.2 | −43 |

From the test results listed in Table 3, it was revealed that the Inventive steels having the components and their contents according to one exemplary embodiment of the present invention do meet the requirements for all process conditions, and therefore the manufactured steels (A-1, B-1, C-1, D-1, E-1, F-1, G-1 and H-1) satisfactorily has a tensile strength of 600 MPa or more and a low yield ratio of 80% or less. On the contrary, it was seen that the Comparative steels I to L that are out of the ranges of the component system of the present invention and the steels, among the Inventive steels, that do not meet the process conditions do not show their excellent physical properties as in the Inventive steels that meet the requirements for all process conditions.

The invention claimed is:

1. A high strength and low yield ratio steel, comprising, by weight percent: C: 0.02 to 0.12%, Si: 0.01 to 0.8%, Mn: 0.3 to 2.5%, P: 0.02% or less, S: 0.01% or less, Al: 0.005 to 0.5%, Nb: 0.06 to 0.10%, B: 3 to 50 ppm, Ti: 0.005 to 0.1%, N: 15 to 150 ppm, Ca: 60 ppm or less, and the balance of Fe and inevitable impurities, and having a tensile strength of 600 MPa or more and a yield ratio of 80% or less, wherein the steel comprises 1 to 5% by volume percent of an MA (martensite/austenite) structure having an average particle size of 5 μm or less and at least 95% by volume percent of granular bainite and bainitic ferrite.

2. The high strength and low yield ratio steel of claim 1, further comprising at least one component selected from the group consisting of, by weight percent: Cr: 0.05 to 1.0%, Mo: 0.01 to 1.0%, Ni: 0.01 to 2.0%, Cu: 0.01 to 1.0% and V: 0.005 to 0.3%.

3. A method for manufacturing a high strength and low yield ratio steel, the method comprising:

re-heating a steel slab at 1050 to 1250° C., the slab comprising, by weight percent: C: 0.02 to 0.12%, Si: 0.01 to 0.8%, Mn: 0.3 to 2.5%, P: 0.02% or less, S: 0.01% or less, Al: 0.005 to 0.5%, Nb: 0.006 to 0.10%, B: 3 to 50 ppm, Ti: 0.005 to 0.1%, N: 15 to 150 ppm, Ca: 60 ppm or less, and the balance of Fe and inevitable impurities;

rough-rolling the re-heated slab at a temperature range of 1250° C. to Tnr;

finish-rolling the rough-rolled plate at a temperature range of Tnr to Bs; and cooling the finish-rolled plate to a finish cooling temperature of 500 to 600° C., wherein the steel comprises 1 to 5% by volume percent of an MA (martensite/austenite) structure having an average particle size of 5 μm or less and at least 95% by volume percent of granular bainite and banitic ferrite.

4. The method of claim 3, wherein the slab further comprises at least one component selected from the group consisting of, by weight percent: Cr: 0.05 to 1.0%, Mo: 0.01 to 1.0%, Ni: 0.01 to 2.0%, Cu: 0.01 to 1.0% and V: 0.005 to 0.3%.

5. The method of claim 3, wherein the operation of cooling the finish-rolled plate is carried out by water-cooling the finish-rolled plate at a cooling rate of 2 to 10° C./s.

* * * * *

UNITED STATES PATENT AND TRADEMARK OFFICE

CERTIFICATE OF CORRECTION

PATENT NO. : 8,702,880 B2
APPLICATION NO. : 12/741401
DATED : April 22, 2014
INVENTOR(S) : Jae Young Cho It is certified that error appears in the above-identified patent and that said Letters Patent is hereby corrected as shown below:

Title Page of the Patent, Column 2, Item (57) Abstract, delete "be" and insert -- Fe --

Title Page of the Patent, Column 2, Item (57) Abstract, delete "of" and insert -- of, --

In the Claims

Column 12, Line 1, Claim 3, delete "0.006" and insert -- 0.06 --

Column 12, Line 13, Claim 3, delete "banitic" and insert -- bainitic --

Signed and Sealed this
Twenty-third Day of September, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,702,880 B2
APPLICATION NO. : 12/741401
DATED : April 22, 2014
INVENTOR(S) : Cho et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 574 days.

Signed and Sealed this
Twenty-ninth Day of September, 2015

Michelle K. Lee

Michelle K. Lee
*Director of the United States Patent and Trademark Office*